United States Patent [19]

Mitrofanov

[11] 4,359,661

[45] Nov. 16, 1982

[54] GEIGER-MUELLER TUBE WITH TUNGSTEN LINER

[75] Inventor: Nicolas Mitrofanov, Cleveland, Ohio

[73] Assignee: The Harshaw Chemical Company, Cleveland, Ohio

[21] Appl. No.: 182,375

[22] Filed: Aug. 29, 1980

[51] Int. Cl.[3] ..... H01J 47/08; H01J 17/06

[52] U.S. Cl. ..... 313/93

[58] Field of Search ..... 313/93

[56] References Cited

U.S. PATENT DOCUMENTS

| | | | |
|---|---|---|---|
| 2,679,609 | 5/1954 | Meloy | 313/93 |
| 3,372,295 | 3/1968 | Sparks | 313/93 |
| 3,892,990 | 7/1975 | Mitrofanov | 313/93 |
| 3,902,092 | 8/1975 | Clark | 313/269 |
| 3,903,444 | 9/1975 | Tessler | 313/93 |
| 3,916,200 | 10/1975 | Sparks et al. | 313/93 X |
| 3,956,654 | 5/1976 | Gleason | 313/61 |
| 4,047,039 | 9/1977 | Houston | 313/93 X |
| 4,180,754 | 12/1979 | Levy | 313/93 |

*Primary Examiner*—Robert Segal

*Attorney, Agent, or Firm*—James A. Lucas

[57] ABSTRACT

A highly sensitive Geiger-Mueller radiation detector with improved temperature stability and working life uses a cathode liner made of tungsten. The liner is resistant to attack by the halogen quench gases which are used in the detector. The method of conditioning the tube for use is much simpler and less expensive than it is for existing tubes.

2 Claims, 3 Drawing Figures

GEIGER-MUELLER TUBE WITH TUNGSTEN LINER

BACKGROUND OF THE INVENTION

Gas-filled radiation detectors have been used for many years to provide qualitative and quantitative information concerning nuclear radiation. Such a detector consists of a hollow cathode defining a gas-filled chamber, and an anode within the chamber electrically insulated from the cathode. A voltage is applied between the anode and cathode. When the detector is placed in a radiation field, nuclear particles enter the chamber, causing ionization and the release of electrons. The ions and electrons are collected and characterized as to energy, type, numbers, etc. The results are typically viewed on an oscilloscope and are recorded and analyzed.

One type of detector is a Geiger-Mueller (GM) tube. A GM tube is characteristically operated in a high voltage range, thereby producing a large output signal which is independent of the nature of the initial ionizing event. Because of its extreme sensitivity, a GM tube can be used to detect all types of nuclear particles including beta, gamma and X-rays.

Geiger-Mueller tubes are presently used for a variety of purposes in research, medicine and industry. Among the varied uses are: detecting and recording particles emitted during experimentation on nuclear radiation; measuring the effect of bombardment on increasing the radioactivity of bombarded products; measuring and recording cosmic radiation; detecting and tracing radioactive substances in biological systems; using artificially activated substances to follow the progress of chemical and mechanical changes; and locating oil bearing strata in well logging. Furthermore, these tubes are used in such devices as oil level detectors or gauges on aircraft where they are subject to severe vibration and widely fluctuating temperatures, pressures and altitudes.

The chamber of a GM tube is filled with a monatomic and/or a diatomic gas which becomes ionized by radiation. Typically a noble gas such as neon or argon is also used. At the same time, a quench gas is used in the chamber to prevent the occurrence of unwanted secondary ionization caused by the release of electrons from the cathode. The quench gas has a lower ionization potential than the noble gas and dissociates to dissipate the excitation energy after pulsing.

Over the years, several quench gases have been used including organic gases such as ethyl alcohol, ethyl formate and methane, and inorganic halogen gases such as bromine and chlorine. The use of bromine is particularly advantageous because it has a very high electron capture cross-section and because its recombination rate after dissociation is nearly 100%. The temperature stability and long life of bromine are also outstanding. For these reasons, bromine quenched counters can be used continuously at temperatures of 300° C. and for short intervals at temperatures as high as 400° C.

A desirable attribute of a GM detector is high sensitivity or ability to detect low levels of ionization. To insure high sensitivity, the cathode is typically plated with an inert and dense (non-porous) layer of a metal such as platinum. Care must be taken to insure that the platinum is plated on the cathode as a coherent, non-porous layer. Among factors involved in insuring an adherent electroplate are the type of substrate surface used for the cathode, thoroughness of surface cleaning and preparation, characteristics of the plating bath, and plating conditions such as current density, temperature, presence or absence of bath impurities, etc. Deviation from optimum can lead to the formation of a porous deposit and attendant premature failure of the tube.

One criterion of performance of a GM tube is the uniformity of the count-rate over the entire span of operational voltages at which the count-rate is relatively independent of voltage. This stability persists over a wide range of operating temperatures. The stability plateau preferably occurs in the high voltage range thereby resulting in an improved pulse height and time resolution. The voltage approaches that value necessary to initiate spontaneous discharge between the conductive anode and cathode. A standard halogen quenched GM tube manufactured by The Harshaw Chemical Company typically exhibits a count-rate shift less than 2.5% and a slope of 8% over a range of 100 volts at a temperature ranging from −40° C. to 225° C. with an operating voltage range of 800 to 1000 volts.

In U.S. Pat. No. 3,342,538, I describe a method of increasing the maximum operating temperature of a GM tube. The method involves passing an electrical current through the tube in the presence of pure oxygen gas to oxidize the cathode surface. The oxygen is then replaced with a gaseous mixture containing halogen and the tube is thermally cycled at progressively higher temperatures to stabilize the oxide surface.

In U.S. Pat. No. 3,892,990, I describe a method of conditioning a GM tube for high temperature service without the necessity of thermally cycling the tube at progressively elevated temperatures. The improved characteristics of the tube are achieved by coating a stainless steel cathode with a thin layer of chromium, platinum or an alloy of nickel and copper. This is followed by passivation of the plated cathode by successively filling the tube chamber with halogen gas under pressure and purging the chamber until starting voltages are essentially constant after which a fresh charge of halogen gas is sealed in the chamber.

For most purposes, platinum is the preferred cathode coating because of its high sensitivity to gamma radiation. However, problems are encountered in the adhesion of platinum when it is plated on the inner surface of larger stainless steel tubes having a diameter of 1" or so. Another problem that is encountered with the very thin layer of platinum is its porosity. When using bromine or chlorine as a quench gas, the porosity of the platinum permits the free halogen in the gas to attack the stainless steel cathode. As the operating temperature increases, the rate of attack becomes even more pronounced. This causes the performance of the tube to degenerate with a drop in the starting voltage, a downward shift in the plateau and an attendant increase in the slope throughout the operating range of the counter. Because of the high cost of platinum, the economics surrounding its use are not favorable. Not to be overlooked is the considerable time and added expense of thermally cycling or passivating the platinum with bromine as described in my earlier patents.

Surprisingly, it has been found that a thin layer of tungsten can be used on the inside surface of a cylindrical cathode to give a GM detector having high sensitivity and outstanding resistance to the halogen gas.

Furthermore, it is surprising and unexpected that the tungsten layer can be applied to the interior of a cylindrical cathode as a thin foil thus omitting the necessity of electrodepositing the layer on the interior surface.

Of considerable significance is the fact that a stainless steel GM tube in which the interior surface of the cathode is coated with a thin layer of chromium oxide and a tungsten foil liner possesses remarkable high temperature stability even though it is not subjected to the thermal cycling or bromine passivation techniques described in my earlier patents.

BRIEF DESCRIPTION OF THE INVENTION

The GM detector of the present invention uses a conventional cylindrical cathode made of, e.g., stainless steel. The interior surface of the cathode consists of a layer of chromium oxide. The oxide surface is lined with a tungsten sleeve to produce a GM detector having (1) outstanding resistance to attack by halogen quenching gases, (2) a slope over the plateau range of voltages as good or better than that of a platinum plated tube, (3) a negligible drop in starting voltages or shift in the plateau upon prolonged use and (4) high sensitivity. Furthermore, the manufacturing costs are lower for this tube than they are for a platinum plated tube.

Referring briefly to the drawings, FIG. 1 is a side view, partially in cross-section, of a Geiger-Mueller tube;

DETAILED DISCUSSION OF THE INVENTION

Figure 1:
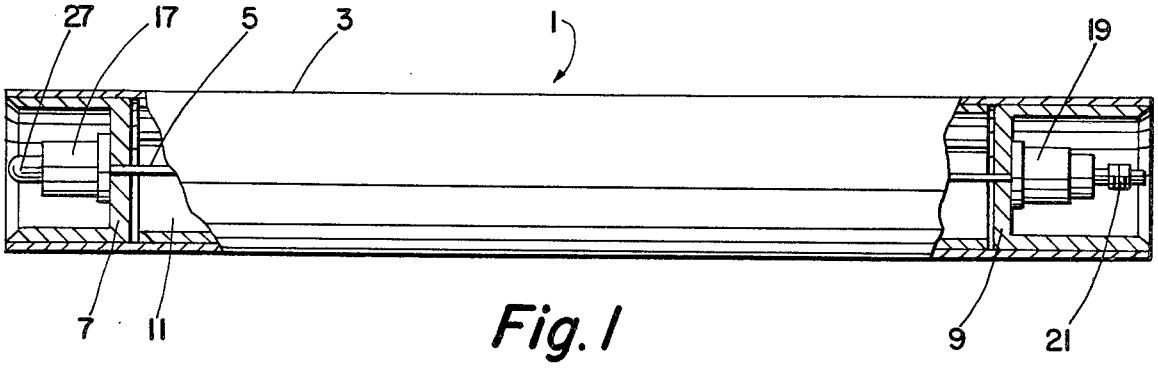

Referring now more specifically to the drawings, FIG. 1 shows a conventional GM detector 1 consisting of a tubular or cylindrical metal cathode 3, a wire anode 5 concentrically disposed within the cathode, and end caps 7, 9 welded to the cathode defining an enclosed chamber therewith. The chamber is filled through a glass tube 27 at one end with a gaseous mixture comprising an ionizing gas, a minor amount of a halogen quenching gas and an inert gas. A typical mixture is 0.1% argon, 1.5% bromine and the remainder neon. Each end of the wire anode is anchored in a ceramic collar 17, 19 and threaded coupling 21 is provided at the end opposite the glass tube to connect the chamber to a suitable radiation counting and measuring system, not shown.

Figure 2:
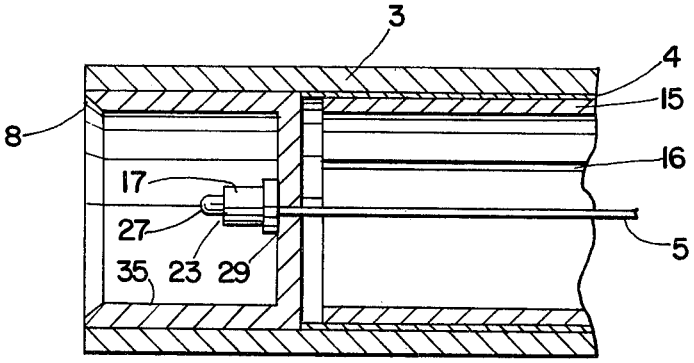
FIG. 2 is an enlarged cross-section of one end of the tube.

In FIG. 2, the filling end of a GM tube is shown in greater detail. The cylindrical cathode 3 is composed of stainless steel and contains a layer 4 of inert chromium oxide on the inner surface. A sleeve or liner 15 of tungsten is in contact with and completely covers the chromium oxide layer. The sleeve is comprised of a thin foil having a thickness of between about 1 and about 2 mils. The two edges of the tungsten foil are in abutting relationship along juncture 16. The end of the cathode 3 is sealed off with a cup-shaped end cap 7, fabricated from a metal such as 446 stainless steel and welded along the rim at 8 to the cathode 3 by, for example, heliarc welding. A ceramic collar 17 is seated on end cap 7. One end of the wire anode 5 is anchored in the collar. A suitable sealant such as solder glass is used to form an air tight seal 29 between the collar and the end cap. The coefficient of expansion of the sealant closely approximates that of the ceramic collar and stainless steel cap in order to prevent cracking during thermal cycling.

An annular passageway (not shown) extends through the collar and through glass tip 27 to permit a vacuum to be drawn and gas to be introduced into the tube. When the purging and filling are complete, the glass tip 27 is heated and closed off to permanently seal the gases within the tube. The junction between the tip 27 and collar 17 is made air tight using a suitable sealant 23 such as solder glass. These details concerning construction of the GM tube are well-known and do not comprise part of the present invention.

The cylindrical cathode is fabricated from tubular stainless steel having a wall thickness of about 10 mil to 35 mil depending on tube size. Type 304 and Type 446 stainless steel have been found to be satisfactory. Other metallic cathodes may be used provided they are relatively resistant to attack by halogen gas at elevated temperatures and can be plated with an adherent layer of hard chromium.

A thin layer of hard chromium is deposited on the interior of the tube from an electroplating bath containing, e.g., chromic acid and sulfuric acid using well established plating procedures. The thickness of the layer is between about 5 and 50 microns. Any other method of producing a thin adherent chromium layer such as spraying, dipping or electroless plating may be used. Following deposition, the chromium layer is cleaned and is then heated at high temperatures of about 600° C. in the presence of oxygen to form an inert surface layer of chromium oxide.

The tungsten foil is available in thin sheets 1 to 2 mils in thickness. The liner is cut from the foil and is then tightly coiled and inserted in the cathode where the spring tension forces it radially outwardly and holds it firmly against the chromium oxide layer on the inner wall of the cathode. Normally, no other means of bonding is required for the tungsten to adhere tightly to the oxide layer.

After the tungsten liner is inserted, the detector is assembled using an anode wire, one or more ceramic plugs and glass seals. The assembly is then sealed to the glass manifold of a vacuum station and heated under high vacuum at a temperature of 350°–400° C.; after 3–4 hours of heating, the tubes are cooled down and filled with a mixture of gases such as argon, a halogen quenching gas such as bromine and an inert gas such as neon. The mixture typically contains approximately 0.1% argon and 1 to 2% bromine with the remainder neon.

The present invention is applicable to GM tubes irrespective of size. These tubes are available in sizes of $\frac{1}{4}''$ O.D. to $1\frac{3}{8}''$ O.D. with active lengths of between $\frac{1}{4}''$ and 18". Although end caps are typically used to seal tubes having diameters of $\frac{1}{2}''$ or larger, smaller tubes can be sealed off with a non-conductive ceramic glass having thermal expansion properties that match those of the cathode.

Unexpectedly, it has been discovered that the GM tube of the present invention does not require the time consuming and expensive passivation treatments described in my earlier patents. Thus, the steps of oxygen glowing and bromine passivation are omitted and the length of time to process the tube at the filling station is substantially reduced.

Figure 3:
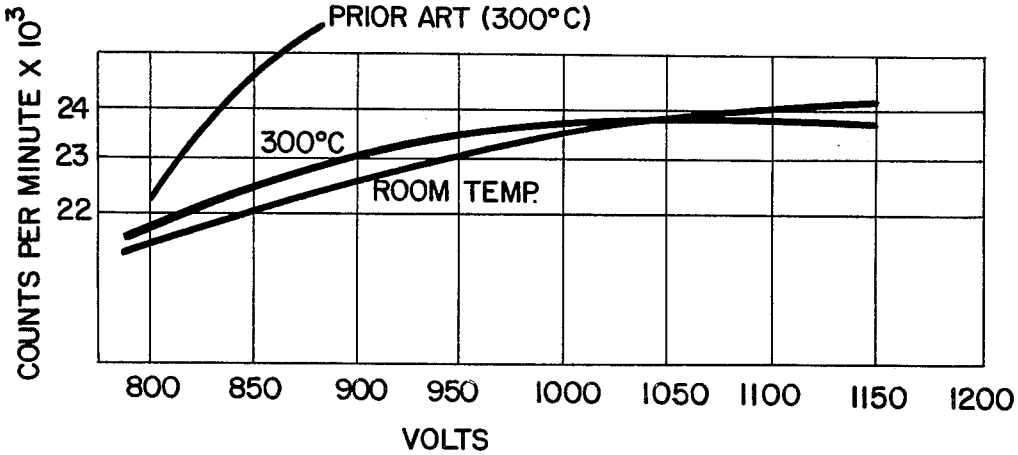
FIG. 3 is a chart showing the performance characteristics of an improved tube of this invention at room temperature and a comparison at elevated temperatures with a prior art tube.

FIG. 3 is a chart showing count rate of two GM tubes as a function of voltage and of temperature. Each GM tube is a model G22-4" tube manufactured by The Harshaw Chemical Company. The tube uses a $\frac{5}{8}''$ O.D. stainless steel cathode with a wall thickness of 10 mils.

One tube is produced according to the teachings of the present invention, using a tungsten sleeve while the other tube contains a layer of platinum electrodeposited on to the cathode.

The two intersecting curves in FIG. 3 show the performance characteristics of the tube of the present invention while the sharply rising curve shows the characteristics of the prior art tube at elevated temperatures.

With the use of the tungsten sleeve to protect the cathode, the count rate at 300° C. is within 1% of the rate at room temperature over the range of operating voltages between 850 and 1150 volts. On the other hand, a tube of the same type plated with a layer of platinum shows a count rate which increases rapidly at 300° C. Tungsten has a high atomic number and a high density, both of which give the metal unusually good absorption cross-section. This makes the metal very sensitive to gamma rays. In addition, and quite unexpectedly, the tungsten metal is chemically stable to chlorine, bromine or other halogen gas used as a quench gas.

Other variations can be made in the design of this improved Geiger-Mueller tube without departing from the scope of the present invention in which,

I claim:

1. In a Geiger-Mueller radiation detector including a relatively large surface stainless steel cathode, a coating of chromium oxide on the interior surface of said cathode, an anode disposed in spaced apart relationship to said cathode in a sealed chamber, and a gaseous mixture confined in said sealed chamber and including an inert gas and a minor amount of a halogen quench gas, the improvement comprising a liner in contact with the chromium oxide layer and consisting of a thin metallic tungsten foil.

2. The detector of claim 1 in which the tungsten foil has a thickness between about 1 and 2 mils.

* * * * *